US007519316B2

(12) United States Patent
Sato

(10) Patent No.: US 7,519,316 B2
(45) Date of Patent: Apr. 14, 2009

(54) IMAGE FORMING APPARATUS AND METHOD FOR FORMING IMAGE

(75) Inventor: Shuitsu Sato, Tokyo (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 257 days.

(21) Appl. No.: 11/473,547

(22) Filed: Jun. 23, 2006

(65) Prior Publication Data

US 2007/0297832 A1 Dec. 27, 2007

(51) Int. Cl.
*G03G 15/08* (2006.01)

(52) U.S. Cl. ..... 399/254; 399/255; 399/256

(58) Field of Classification Search ..... 399/252, 399/253, 254, 255, 256, 257, 258, 260
See application file for complete search history.

(56) References Cited

U.S. PATENT DOCUMENTS 7,123,863 B2 * 10/2006 Yamada et al. ..... 399/227
7,359,662 B2 * 4/2008 Yamada et al. ..... 399/284

FOREIGN PATENT DOCUMENTS

| | | |
|---|---|---|
| JP | 06-059571 | 3/1994 |
| JP | 06-167886 | 6/1994 |
| JP | 11-219010 | 8/1999 |

* cited by examiner

*Primary Examiner*—Hoan H Tran
(74) *Attorney, Agent, or Firm*—Amin, Turocy & Calvin, LLP

(57) ABSTRACT

In an image forming apparatus, a developer agitation member has a mechanism to vary its driving force, and the driving force of the developer agitation member is changed by a control unit according to the information of the number of times of image formation from a counter.

9 Claims, 3 Drawing Sheets

IMAGE FORMING APPARATUS AND METHOD FOR FORMING IMAGE

BACKGROUND OF THE INVENTION

A toner and a carrier included in a developer are previously mixed at a specified concentration, and are put in a developing process unit having an agitation and mixing mechanism. Here, the toner and the carrier are mixed by the agitation and mixing mechanism, and by this, the toner is friction charged and is attached to a latent image of a photoconductor, and it is subjected to development.

It is known that the developer deteriorates due to long-term use, and its fluidity is reduced. Since the fluidity is reduced, the agitation state is changed between at the initial stage and after long-term use, and it becomes difficult to keep the charging performance of the initial toner.

When such a developer is used over a long period of time, although a new toner is supplied according to the consumption of toner, the developer deteriorates due to the deterioration of the carrier by being spent, the separation of an additive from the surface of the toner, a degraded toner that is not developed but remains on a photoconductor and has poor charging performance, and various disadvantages occur when the developer is near the end of the life.

As a method of keeping the developer characteristic for a long period of time, there is disclosed a method in which a small amount of carrier is mixed with a supplementary toner and is supplemented whenever necessary, and the performance of the carrier deteriorated by being spent is supplemented, or a method in which a developing bias is variably controlled according to the life time, and the developing operation of the toner whose charging performance is reduced is supplemented. However, in the above methods, a disadvantage in an image due to a reduction in fluidity of the developer, which occurs in the case of long-term use, has not been resolved.

In order to resolve the disadvantage of the image due to the change of the fluidity in the life of the developer, for example, JP-A-6-167886 discloses a method in which a fluidity sensor is installed in a developing unit, the driving force of agitation means is increased by a detection signal from the sensor when the fluidity of the developer is lowered, and the fluidity of the developer is recovered. Although this method is effective in the recovery of the fluidity of the developer, since it is necessary to install the fluidity sensor in the developing unit and to provide means for detecting the signal from the sensor, the structure of the developing unit becomes complicated and the cost is high.

Besides, JP-A-6-59571 discloses a method in which in a developing apparatus, the fluidity of a toner is measured by detecting the amount of the toner transported from a toner hopper to a developing unit, and the rotation speed or rotation time of a rotator to supply the toner from the toner hopper to the developing unit is controlled. In this method, although it is possible to detect the fluidity of only the toner, it is difficult to detect the fluidity of the developer in which the toner and carrier are mixed.

BRIEF SUMMARY OF THE INVENTION

The invention has been made in view of the above circumstances, and it is an object to provide a developing apparatus which can stably keep the charge amount of a developer throughout the life in a developing process unit that includes the developer containing a toner and a carrier and has an agitating and mixing mechanism, and a developing method using the same.

The image forming apparatus of the invention includes a developing unit that is provided on an image bearing body, and includes an area to contain a developer, a developer agitation member to agitate and to charge the developer in the area, a mechanism to vary a driving force of the developer agitation member, and a developer bearing member to supply the charged developer to an electrostatic latent image formed on the image bearing body, a transfer unit to transfer a developer image developed by the developing unit onto a recording member, a fixing unit to fix the transferred developer image on the recording member, a counter to count a number of times of image formation, and a control unit to change the driving force of the developer agitation member according to information of the number of times of image formation from the counter.

The image forming method of the invention includes a step of agitating and charging a developer contained in a developing unit provided on an image bearing body by using a developer agitation member provided with a mechanism to vary a driving force of the developer agitation member, a step of supplying the charged developer by using a developer bearing member from the developing unit to an electrostatic latent image formed on the image bearing body, a step of transferring a developer image developed by the developing unit onto a recording member in a transfer unit, a fixing step of fixing the transferred developer image on the recording member in a fixing unit, a step of counting a number of times of image formation by a counter, and a step of changing the driving force of the developer agitation member in a control unit according to information of the number of times of image formation from the counter.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

An image forming apparatus of the invention includes a developing unit that is provided on an image bearing body, and includes an area to contain a developer, a developer agitation member to agitate and to charge the developer in the area, a mechanism to vary a driving force of the developer agitation member, and a developer bearing member to supply the charged developer to an electrostatic latent image formed on the image bearing body, a transfer unit to transfer a developer image developed by the developing unit onto a recording member, a fixing unit to fix the transferred developer image on the recording member, and a counter to count a number of times of image formation, and is characterized by including a control unit to change the driving force of the developer agitation member according to information of the number of times of image formation from the counter.

An image forming method of the invention is a method of forming an image by using the above image forming apparatus and includes a step of agitating and charging a developer contained in a developing unit provided on an image bearing body by using a developer agitation member provided with a mechanism to vary a driving force of the developer agitation member, a step of supplying the charged developer by using a developer bearing member from the developing unit to an electrostatic latent image formed on the image bearing body, a step of transferring a developer image developed by the developing unit onto a recording member in a transfer unit, a fixing step of fixing the transferred developer image on the recording member in a fixing unit, a step of counting a number of times of image formation by a counter, and a step of changing the driving force of the developer agitation member in a control unit according to information of the number of times of image formation from the counter.

According to the invention, without using a fluidity sensor and means for detecting a supplement amount in a developing apparatus, the members constituting the developing apparatus are used as they are, the charge amount of the developer is stably kept throughout the life, a uniform and clear image without defects such as uneven concentration and fading can be obtained throughout the life, and defects, such as toner scattering or toner dropping, in the inside of the apparatus can be resolved.

Hereinafter, the invention will be described in more detail with reference to the drawings.

Figure 1:
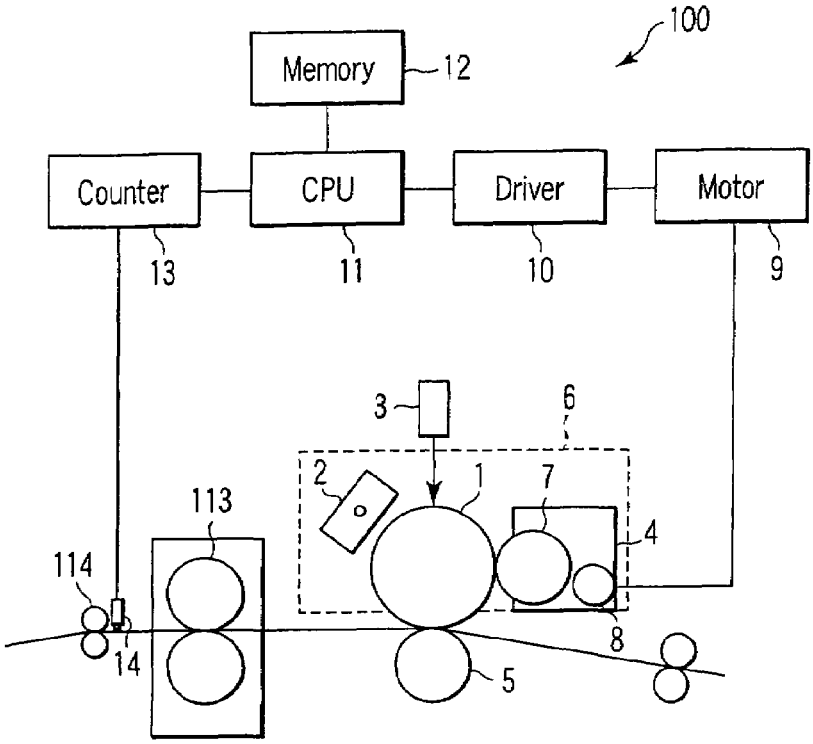
FIG. 1 is a schematic view showing a structure of an example of an image forming apparatus of the invention.

FIG. 1 is a schematic view showing a structure of an example of an image forming apparatus of the invention.

In this image forming apparatus 100, an image bearing body 1 is a photoconductive drum in which an organic or amorphous silicon photosensitive layer is provided on a conductive substrate. Here, a description will be given to an example in which an organic photoconductor charged with minus polarity is used as the photoconductive drum.

The image bearing body 1 is uniformly charged to, for example, −500 V by a charger 2, for example, a well-known roller charger, corona charger, Scorotron charger or the like. Thereafter, for example, an image-modulated laser beam or exposure 3 by light exposure means such as an LED is applied, and an electrostatic latent image is formed on the surface of the image bearing body 1. At this time, the potential of an exposed surface of the photoconductor becomes, for example, −80 V. Then, the electrostatic latent image is visualized by a developing apparatus 4. A two-component developer in which a nonmagnetic toner charged with negative polarity and a magnetic carrier are mixed is contained in the developing apparatus 4. In this developing apparatus 4, the two-component developer is agitated by an agitation mechanism 8 including a rotatable agitation blade and is friction charged. Carrier beads are formed on a developing roller 7 including a magnet, and a developing bias voltage of about −200 to −400 V is applied to the developing roller 7. By this, the toner attached to the carrier is attached to the exposed part of the surface of the photoconductor and forms a toner image. On the other hand, the toner is not attached to the non-exposed part. Incidentally, as the developing bias voltage, the DC bias superposed with an AC bias of 1 to 10 kHz and 500 to 2000 Vp-p may be applied.

A sheet is supplied between the photoconductor 1 and a transfer member 5 such as, for example, a transfer roller by a not-shown sheet supply transport device, and a bias voltage of about plus 300 to 3 kV is applied to the transfer member 5, so that the toner image is transferred onto the sheet, and a transfer image is obtained. Besides, instead of the transfer roller, a transfer blade, a transfer brush or the like can be used. The sheet on which the transfer image has been formed is introduced into a fixing apparatus 113, the toner is fixed to the sheet by heat and pressure in the fixing apparatus 113, and a copy image is formed. The sheet on which the copy image has been formed is then discharged by a paper discharge mechanism 114. The paper discharge in the discharge mechanism 114 can be detected by a sensor 14 mounted just before the paper discharge mechanism 114.

Here, the agitation mechanism 8 includes a motor 9 to rotation-drive an agitation blade and a driver 10 to activate the motor 9 at a specified driving force, for example, a rotation speed, and this driver 10 is connected to a CPU 11. The CPU 11 is connected with a memory 12 and a counter 13 to count the number of discharged sheets corresponding to the number of times of image formation.

According to an embodiment of the invention, the flow rate change characteristic of the developer to be used corresponding to the initial stage and the end of the life can be obtained in advance.

Based on the flow rate change characteristic, the change of the rotation speed corresponding to the number of times of image formation is previously determined and can be stored in the memory 12 connected to the CPU 11.

The counter 13 is connected to the sensor 14 to detect the paper discharge provided in the vicinity of, for example, the paper discharge mechanism 114, and can count the number of discharged sheets.

Based on the information of the number of times of image formation from the counter 13, at the number of times of image formation which is stored in the memory 12 and at which the rotation speed is changed, the CPU 11 changes the setting of the rotation speed in the driver 10.

In the image forming apparatus, the flow rate change characteristic of the developer to be used is previously measured, the rotation speed of the agitation mechanism corresponding to the number of times of image formation is previously determined from the flow rate change characteristic, and the agitation mechanism is controlled. Thus, without adding a specific apparatus, such as a fluidity sensor and means for detecting a supply amount, into the developing apparatus, the rotation speed can be changed correspondingly to the fluidity change throughout the life of the developer, and therefore, the charge amount of the developer can be stably kept at low cost throughout the life.

From this, it is possible to resolve such defects that the fluidity of the developer is changed, the agitation becomes insufficient, and the charge-imparting performance is reduced, and since the charging of the toner is insufficient, the development is not sufficiently performed, the image concentration is lowered, and the inside of the image forming apparatus is contaminated by the toner scattering or spills.

The flow rate change characteristic can be obtained by, for example, powder fluidity measurement apparatus FT-4 made by SYSMEX CORPORATION.

Figure 2:
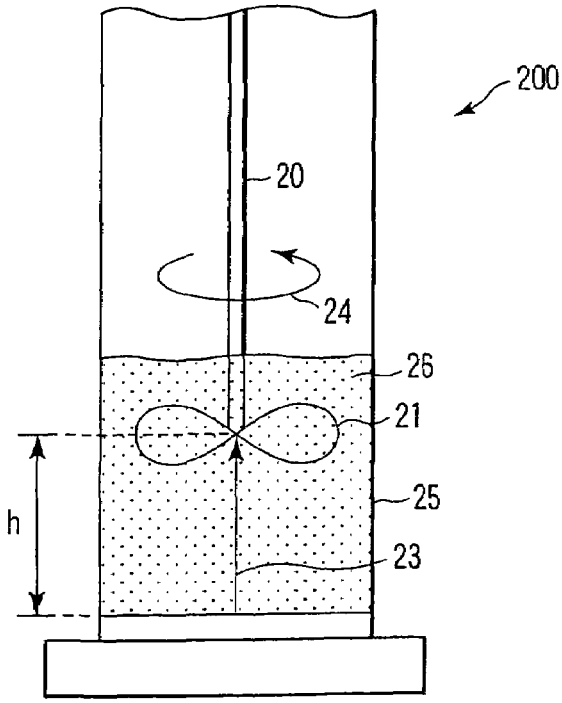
FIG. 2 is a schematic view showing a structure of an example of a powder fluidity measuring apparatus.

FIG. 2 is a schematic view showing a structure of the powder fluidity measuring apparatus FT-4.

As shown in the drawing, this apparatus 200 includes a container 25 to contain a developer 26, and a rotary vane 21 disposed in the container 25 and moved vertically upward and downward.

The fluidity of the developer is measured such that the rotary vane rotating in a direction of an arrow 24 is put into the developer 26 filled in the container 25, and the measurement is made as the sum of a rotation torque applied in order to lower it at a constant speed and a vertical load imposed in a direction of an arrow 23.

Here, the rotation speed is expressed by a speed at which the rotary vane is moved downward from the height h, and is made −100 mm/sec.

Besides, the spiral angle of the rotary vane is made 5 degrees, and the measurement capacity of the container is made 25 ml.

The fluidity of the developer is measured 8 times in the condition as stated above, and the average value is made a reference energy.

Figure 3:
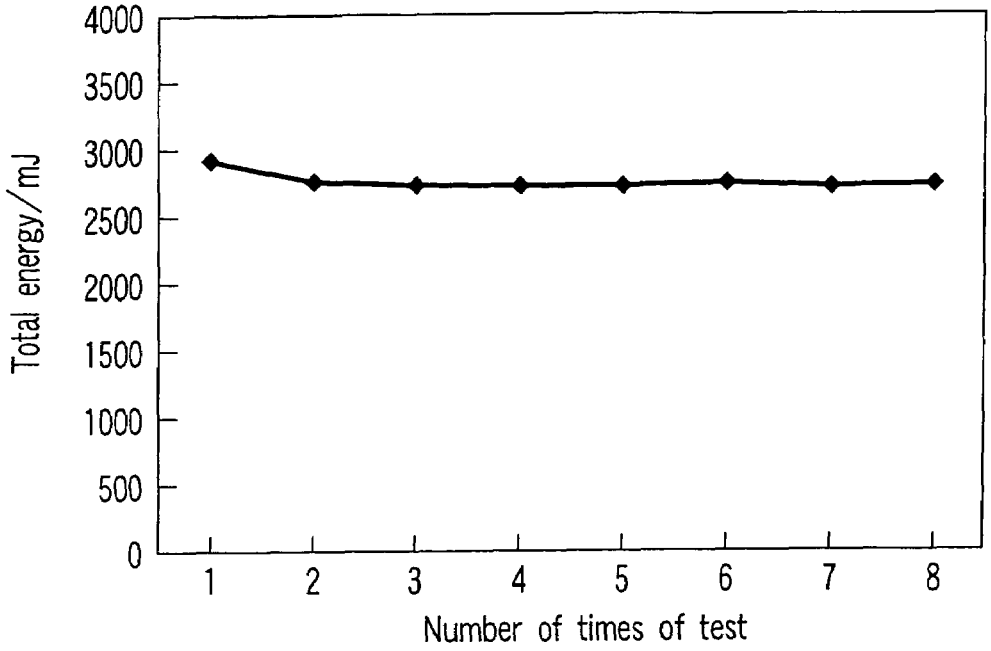
FIG. 3 is a graph showing an example of a measurement result of fluidity of a developer.

FIG. 3 is a graph showing an example of the measurement result of the fluidity of the developer.

As shown in the drawing, the measurement value of the developer is stable from the initial value, and it is appropriate to take the average value as the reference energy.

Incidentally, with respect to the fluidity of only the toner, since the initial value is unstable, the last measurement value is often made the reference energy.

Besides, the rotation speed of the rotary vane is changed stepwise between −100 and −10 mm/sec, the lowest sum of the rotation torque and the vertical load is made energy L, the highest one is made energy H, and the difference between the energy L and the energy H is made an energy change.

Figure 4:
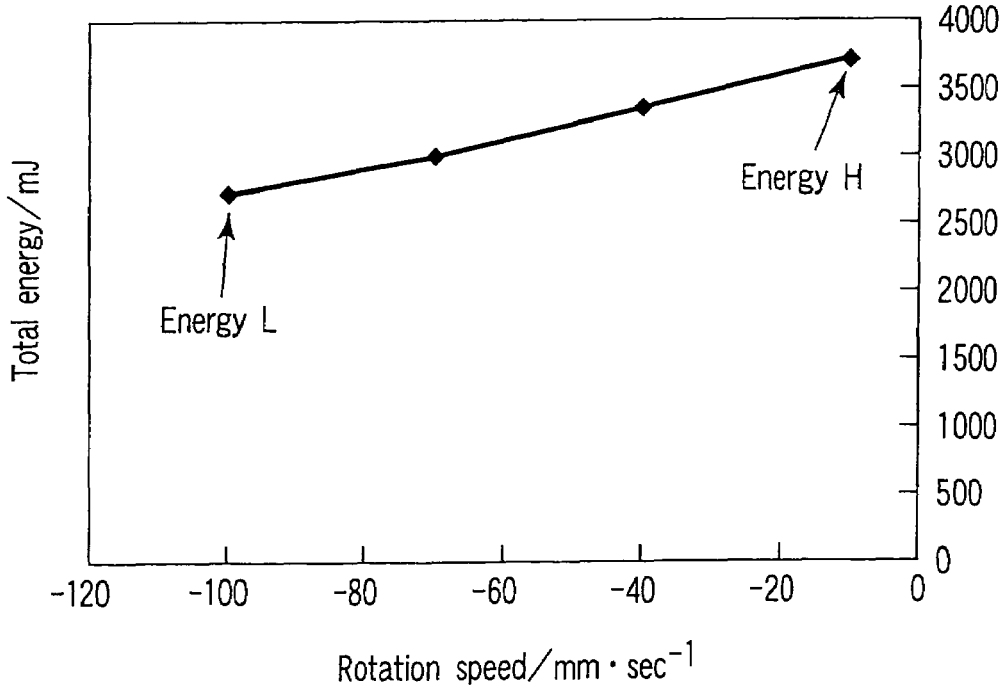
FIG. 4 is a graph showing an example of a relation between a rotation speed of a rotary vane and fluidity of a developer.

FIG. 4 is a graph showing an example of a relation between the rotation speed of the rotary vane and the fluidity of the developer.

As the toner and carrier included in the developer used in the invention, well-known ones can be used.

As the toner, toner produced by melting, kneading, and milling/classifying method, or toner synthesized by various chemical methods can be used.

Besides, as the carrier, carrier made of iron powder or ferrite, carrier coated with various resins, or carrier in which iron powder or fine ferrite powder is dispersed in resin can be used.

Hereinafter, examples are shown, and specifically, the invention will be described.

As a material of a developer A, 900 g of ferrite carrier, and 100 g of toner in which

| | | |
|---|---|---|
| binder resin | polyester resin | 100 wt. % |
| coloring agent | yellow pigment py-180 | 7 wt. % |
| wax 1 | carnauba wax | 2 wt. % |
| wax 2 | PP wax | 5 wt. % and |
| CCA | Zr metal complex | 1 wt. % |

were melted, kneaded, milled, and classified to form a mixture having an average particle diameter of 8 μm and 100 wt. % and including

| | | |
|---|---|---|
| outer additive 1 | hydrophobic silica | 2.5 wt. % and |
| outer additive 2 | hydrophobic titanium oxide | 0.5 wt. % |

were prepared.

The carrier and the toner were put in a polyethylene bottle of 1 liter, and after mixing, agitation was performed by a turbulence mixer for 1 hour, and the initial developer A was obtained.

With respect to a developer B, the initial developer A was put in an apparatus obtained by improving a developing apparatus so that agitation could be performed by forcible driving, and the agitation was performed under conditions where an agitation mechanism was rotated at an agitation speed of 210 mm/sec and the agitation was performed continuously for 17 hours, so that the life equivalent developer B was made which was a developer deteriorated into a state similar to the life equivalent to 60000 sheets.

Incidentally, in this example, since the housing of the developing unit is black, a yellow toner was used so that the evaluation of toner scattering and toner dropping was visually easily performed, and the condition became more strict.

Table 1 shows the flow rate change characteristic.

TABLE 1

| Developer | Reference energy (mJ) | Energy H (mJ) | Energy L (mJ) | Energy change (mJ) | Change rate (%) | Inclination |
|---|---|---|---|---|---|---|
| A | 2759 | 3730 | 2740 | 990 | 1.361 | 11.1 |
| B | 3961 | 5380 | 3920 | 1460 | 1.372 | 16.5 |

As shown in Table 1, since the life equivalent developer B is equivalent to the developer in which the life equivalent to 60000 sheets is conducted, it has been understood that as compared with the initial developer A, the reference energy is high, and the fluidity is inferior. It has been understood that since the energy change amount as the difference between the energy H as the maximum energy and the energy L as the minimum energy is large, and the inclination is also large, the load applied to the agitation mechanism of the developing process unit is large.

In an embodiment of the invention, when the flow rate change characteristic of the initial developer is E1, the flow rate change characteristic of the developer equivalent to the life by the forcible agitation apparatus is E2, the initial rotation speed of the agitation mechanism in the developing apparatus is R1, and the rotation speed at the life end is R2, the control can be performed so that the relation indicated by the lower expression can be obtained.

$$R1*E2=R2*E1$$

In the case where the initial developer A is used, the control can be performed so that the peripheral speed at the time point of arrival at the 60000 sheets life is 1460/990=1.47 times the initial peripheral speed. The effect of the invention can be obtained by application to the image forming apparatus having the function to perform the control of linearly varying the rotation speed of the agitation mechanism according to the initial flow rate change characteristic of the developer and the flow rate change characteristic at the life end.

Following examples were performed using an apparatus improved such that in a black developing unit of MFP (e-Studio 4511) made by TOSHIBA TEC CORPORATION, the peripheral speed of an agitation mechanism could be varied. That is, the initial rotation speed and the rotation speed at the life end were previously inputted to a control CPU, so that the rotation speed could be changed linearly and briefly from the initial stage to the life end.

EXAMPLE 1

The developer A was used, the initial rotation speed of the agitation mechanism was 300 mm/sec, the control was performed to briefly change the rotation speed so that the rotation speed of the agitation mechanism at the time point of 60000 sheets was 1460/990=1.47 times as high, that is, 440 mm/sec, and the image formation was repeatedly performed.

Figure 5:
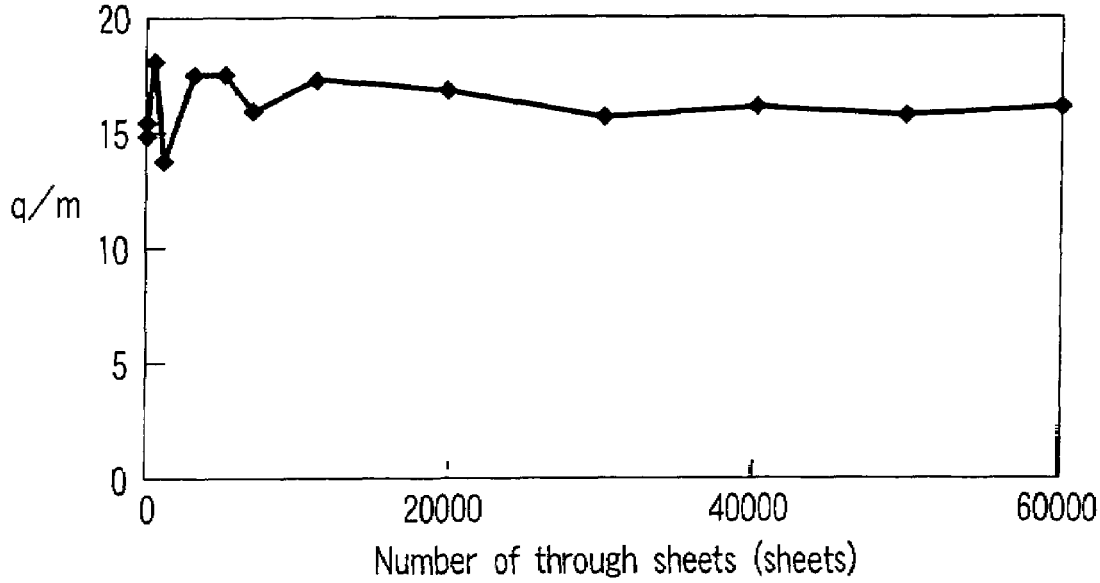
FIG. 5 is a graph showing an example of a relation between the number of through sheets and the charge amount of a developer in the image forming apparatus of the invention.

FIG. 5 shows the change of the charge amount at this time.

As is apparent from the drawing, the charge amount is stable from the life initial stage to the time point of 60000 sheets, and when the obtained image was visually confirmed, the uniform and clear image without defects such as uneven concentration and fading were stably obtained from the life initial stage to the time point of 60000 sheets.

The level of the toner scattering and toner dropping in the inside of the apparatus was level 1.

The toner scattering and the toner dropping were measured by using a digital camera or the like to take a still picture of the state of the periphery of the developing unit in the inside of the machine body and observing it, limitation samples of five stages were created, and an evaluation was performed such that a state in which there was no toner scattering and no toner dropping was level 1, a state in which the toner was attached to a part of the surface of the developing unit by the toner scattering or the toner slightly dropped from both ends of the developing unit was level 2, a state in which the toner was attached to the whole of the surface of the developing unit by the toner scattering or the toner was deposited on a gnathic portion of the developing unit was level 3, a state in which the toner was attached to the periphery of an exhaust hole by the toner scattering or the toner is deposited in the inside of the body by the toner dropping although an influence is not exerted on the image was level 4, and a state in which the scattered toner was spouted to the outside of the machine body or the toner subjected to the toner dropping dropped onto the image and contaminated the image was level 5. The practical range is level 1 to 3.

The charge amount was measured by a suction blowoff charge amount measuring apparatus (TB-220, made by KYOCERA Chemical Corporation) at every 1K sheets till 10K sheets and at every 10 K sheets after 10K sheets.

COMPARATIVE EXAMPLE 1

Figure 6:
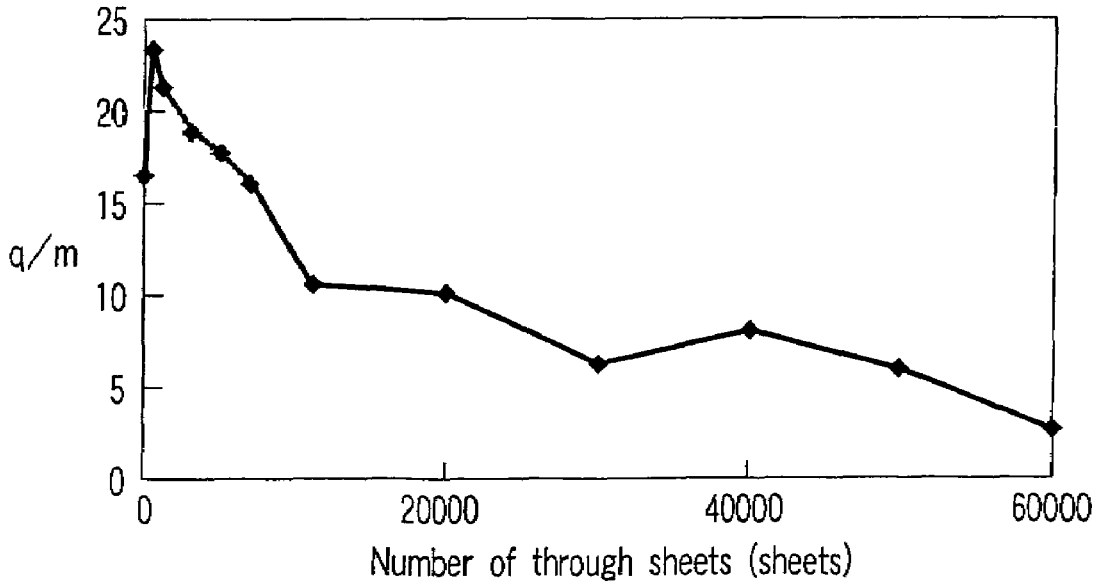
FIG. 6 is a graph showing another example of the relation between the number of through sheets and the charge amount of a developer in the image forming apparatus of the invention.

The developer A was used, the rotation speed of the agitation mechanism was 300 mm/sec from the initial stage to 60000 sheets, and the image formation was repeatedly performed. FIG. 6 shows the change of the charge amount.

As is apparent from the drawing, with the life, the charge amount is reduced, and it has been found that the developer is not sufficiently mixed. As stated above, as the charge amount was reduced, the development of the toner did not work well, and there occurred defects that uneven concentration and fading occurred in the obtained image, and the inside of the copying machine was contaminated by the toner dropping or scattering from the developing unit.

The level of the toner scattering and toner dropping in the inside of the apparatus was level 4.

EXAMPLE 2

60 g of toner similar to the toner used for the developer A, and 940 g of ferrite carrier were mixed and prepared similarly to the developer A, and an initial developer C was obtained. Similarly to the developer B, the developer C was used and a developer D equivalent to the 60000 sheet life was obtained. Table 2 shows the flow rate change characteristic of the developer D.

TABLE 2

| Developer | Reference energy (mJ) | Energy H (mJ) | Energy L (mJ) | Energy change (mJ) | Change rate (%) | Inclination |
|---|---|---|---|---|---|---|
| C | 2485.75 | 2987 | 2476 | 511 | 1.206 | 5.6 |
| D | 2729.5 | 3274 | 2675 | 599 | 1.224 | 6.4 |

The initial rotation speed of the agitation mechanism was 300 mm/sec, the control was performed to briefly change the rotation speed so that the rotation speed of the developing process unit agitation mechanism at the time point of 60000 sheets was 599/511=1.17 times as high, that is, 350 mm/sec, and the image formation was repeatedly performed. Similarly to example 1, the charge amount was stable from the life initial stage to the time point of 60000 sheets, and with respect to an obtained image, the uniform and clear image without defects such as uneven concentration and fading was obtained stably from the life initial stage to the time point of 60000 sheets. Besides, the level of the toner scattering and toner dropping in the inside of the apparatus was level 1.

EXAMPLE 3

80 g of toner similar to the toner used for the developer A and 920 g of ferrite carrier were mixed and prepared similarly to the developer A and a developer E was obtained.

Besides, similarly to the developer B, the developer E was changed and a developer F equivalent to 60000 sheets life was obtained. Table 3 shows the flow rate change characteristic.

TABLE 3

| Developer | Reference energy (mJ) | Energy H (mJ) | Energy L (mJ) | Energy change (mJ) | Change rate (%) | Inclination |
|---|---|---|---|---|---|---|
| E | 2477 | 3180 | 2439 | 741 | 1.304 | 8.0 |
| F | 4441 | 5400 | 4370 | 1030 | 1.236 | 11.5 |

The initial peripheral speed of the developing process unit agitation mechanism was 300 mm/sec, the control was performed to briefly change the rotation speed so that the peripheral speed of the developing process unit agitation mechanism at the time point of 60000 sheets was 1030/741=1.39 times as high, that is, 415 mm/sec, and the image formation was repeatedly performed. Similarly to Example 1, the charge amount was stable from the life initial stage to the time point of 60000 sheets, and with respect to an obtained image, the uniform and clear image without defects such as uneven concentration and fading could be obtained from the life initial stage to the time point of 60000 sheets. Besides, the level of the toner scattering and toner dropping in the inside of the apparatus was level 1.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus comprising:

a developing unit that is provided around an image bearing body, and includes a container to contain a developer, a mixer to agitate and to charge the developer in the developing unit, a mechanism to vary a driving force of the mixer, and a developer bearing member to supply the charged developer to an electrostatic latent image formed on the image bearing body;

a transfer unit to transfer a developer image developed by the developing unit onto a recording member;

a fixing unit to fix the transferred developer image on the recording member;

a counter to count a number of times of image formation; and a control unit to change the driving force of the mixer according to information of the number of times of image formation from the counter, wherein the change of the driving force according to the number of times of image formation is previously determined based on a flow rate change characteristic of the developer.

2. The image forming apparatus according to claim 1, wherein the flow rate change characteristic is measured as total energy of a rotation torque and a vertical load at a time when, after the developer is contained in a container provided with a rotary vane capable of moving vertically upward and downward, the rotary vane is moved downward, and is obtained as an energy change (H-L) as a difference between a maximum energy H and a minimum energy L at a time when a rotation speed of the rotary vane is varied.

3. The image forming apparatus according to claim 1, wherein when the flow rate change characteristic at an initial stage is E1, the driving force of the mixer at the initial stage is R1, the flow rate change characteristic at a life end is E2, and a value of the driving force of the mixer at the life end is R2, the driving force of the mixer is controlled to satisfy a relation expressed by R1*E2=R2*E1.

4. An image forming apparatus comprising:

developing means that is provided around an image bearing body, and includes containing means for containing a developer, developer agitation means for agitating and charging the developer in the developing means, a mechanism to vary a driving force of the developer agitation means, and a developer bearing member to supply the charged developer to an electrostatic latent image formed on the image bearing body:

transfer means for transferring a developer image developed by the developing means onto a recording member;

fixing means for fixing the transferred developer image on the recording member:

a counter to count a number of times of image formation; and a control unit to change the driving force of the developer agitation means according to information of the number of times of image formation from the counter, wherein the change of the driving force according to the number of times of image formation is previously determined based on a flow rate change characteristic of the developer.

5. The image forming apparatus according to claim 4, wherein the flow rate change characteristic is measured as total energy of a rotation torque and a vertical load at a time when, after the developer is contained in a container provided with a rotary vane capable of moving vertically upward and downward, the rotary vane is moved downward, and is obtained as an energy change (H-L) as a difference between a maximum energy H and a minimum energy L at a time when a rotation speed of the rotary vane is varied.

6. The image forming apparatus according to claim 4, wherein when the flow rate change characteristic at an initial stage is E1, the driving force of the developer agitation means at the initial stage is R1, the flow rate change characteristic at a life end is E2, and a value of the driving force of the developer agitation means at the life end is R2, the driving force of the developer agitation means is controlled to satisfy a relation expressed by R1*E2=R2*E1.

7. An image forming method comprising:

a step of agitating and charging a developer contained in a developing unit provided around an image bearing body by using a mixer provided with a mechanism to vary a driving force of the mixer, a step of supplying the charged developer by using a developer bearing member from the developing unit to an electrostatic latent image formed on the image bearing body;

a step of transferring a developer image developed by the developing unit onto a recording member in a transfer unit;

a fixing step of fixing the transferred developer image on the recording member in a fixing unit;

a step of counting a number of times of image formation by a counter; and a step of changing the driving force of the mixer in a control unit according to information of the number of times of image formation from the counter, wherein the change of the driving force according to the number of times of image formation is previously determined based on a flow rate change characteristic of the developer.

8. The image forming method according to claim 7, wherein the flow rate change characteristic is measured as total energy of a rotation torque and a vertical load at a time when, after the developer is contained in a container provided with a rotary vane capable of moving vertically upward and downward, the rotary vane is moved downward, and is obtained as an energy change (H-L) as a difference between a maximum energy H and a minimum energy L at a time when a rotation speed of the rotary vane is varied.

9. The image forming method according to claim 7, wherein when the flow rate change characteristic at an initial stage is E1, the driving force of the mixer at the initial stage is R1, the flow rate change characteristic at a life end is E2, and a value of the driving force of the mixer at the life end is R2, the driving force of the mixer is controlled to satisfy a relation expressed by R1*E2R2*E1.

* * * * *